US008025363B2

(12) United States Patent
Kondo

(10) Patent No.: US 8,025,363 B2
(45) Date of Patent: Sep. 27, 2011

(54) LIQUID DROPLET JETTING APPARATUS

(75) Inventor: Hirofumi Kondo, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 516 days.

(21) Appl. No.: 12/146,285

(22) Filed: Jun. 25, 2008

(65) Prior Publication Data

US 2008/0316274 A1 Dec. 25, 2008

(30) Foreign Application Priority Data

Jun. 25, 2007 (JP) ..... 2007-166615

(51) Int. Cl.
*B41J 2/14* (2006.01)

(52) U.S. Cl. ..... 347/50

(58) Field of Classification Search ..... 347/50, 347/58, 59

See application file for complete search history.

(56) References Cited

U.S. PATENT DOCUMENTS 6,305,784 B1 * 10/2001 Hino ..... 347/49
6,386,672 B1 * 5/2002 Kimura et al. ..... 347/18
7,252,358 B2 8/2007 Katayama
7,294,952 B2 11/2007 Ito
2006/0087532 A1 4/2006 Takata et al.

FOREIGN PATENT DOCUMENTS

JP 3520658 B2 10/1997
JP 2004-314608 A 11/2004
JP 2005-322850 A 11/2005
JP 2006-123246 A 5/2006

* cited by examiner

*Primary Examiner* — An Do
(74) *Attorney, Agent, or Firm* — Baker Botts L.L.P.

(57) ABSTRACT

A liquid droplet jetting apparatus includes a jetting head unit having a nozzle which jets liquid droplets; an electric circuit board having a wiring and a circuit component which are connected to the jetting head unit and having one surface which is electrically insulated from the wiring and the circuit component; and a box-shaped head holder which supports the jetting head unit and the electric circuit board and has an opening. The jetting head unit and the electric circuit board are electrically connected with each other in the head holder; the jetting head unit is fixed to the head holder so as to airtightly close an inside of the head holder; and the electric circuit board is fixed to the head holder to airtightly close the inside of the head holder, with the one surface of the electric circuit board facing the outside of the head holder.

14 Claims, 7 Drawing Sheets

LIQUID DROPLET JETTING APPARATUS

CROSS REFERENCE TO RELATED APPLICATION

The present application claims priority from Japanese Patent Application No. 2007-166615, filed on Jun. 25, 2007, the disclosure of which is incorporated herein by reference in its entirety.

BACKGROUND OF THE INVENTION

1. Field of the Invention

The present invention relates to a liquid droplet jetting apparatus including a jetting head unit which jets liquid droplets, in particular, to a structure capable of preventing minute liquid droplets (mist), which are generated when the liquid droplets are jetted from nozzles, from entering a head holder including the jetting head unit.

2. Description of the Related Art

In a liquid droplet jetting apparatus, for example, an ink-jet recording apparatus described in US Patent Publication No. 2006087532 (corresponding to Japanese Patent Application Laid-open No. 2006-123246), a jetting head unit (recording head) which jets liquid droplets (ink droplets) is provided on a side of a lower surface of a box-shaped head holder. An electric circuit board is disposed on an upper side of the head holder, and a cover provided on a side of an upper surface of the electric circuit board covers an opening of the head holder.

When the ink droplets are jetted from a nozzle of the recording head, not only main ink droplets which form dots on a recording paper are jetted, but also minute ink droplets in mist form, that is, ink mist, are generated. This ink mist can pass through even a narrow gap. Therefore, if the ink mist enters from a gap between the aforesaid cover and opening of the head holder and adheres to a conductive portion of the electric circuit board, ion migration occurs, which may possibly cause electric short circuit.

To avoid this phenomenon, in the ink-jet recording apparatus described in US Patent Publication No. 2006087532, a shielding member to block the entrance of the ink mist is interposed in a gap which is formed between a peripheral edge surrounding an electric circuit formation area in the electric circuit board and a rear surface of the cover.

To meet a recent demand for higher recording speed and higher density of a recording apparatus, the number of nozzles jetting liquid has been increasing. Therefore, a size of a jetting head becomes large and a size of a head holder also becomes large. Accordingly, when the cover is provided as in the ink-jet recording apparatus described in US Patent Publication No. 2006087532, the cover has to be made larger, and a carriage having these components thereon accordingly becomes heavier. A carriage motor also has to be made larger so that the carriage with the increased weight can move at a higher speed (higher recording speed). Thus, the whole recording apparatus becomes larger and heavier, which causes a problem of an increase in manufacturing cost.

SUMMARY OF THE INVENTION

An object of the present invention is to solve the aforesaid problems, and the present invention can prevent a short circuit phenomenon of an electric circuit board caused by minute liquid droplets (mist) generated and floating in a liquid droplet jetting apparatus. Another object of the present invention is to provide a structure which can realize a compact and light-weighted liquid droplet jetting apparatus.

According to a first aspect of the present invention, there is provided a liquid droplet jetting apparatus which jets liquid droplets of a liquid, including: a jetting head unit having a nozzle which jets the liquid droplets; an electric circuit board having a wiring and a circuit component which are connected to the jetting head unit and having one surface which is electrically insulated from the wiring and the circuit component; and a box-shaped head holder which supports the jetting head unit and the electric circuit board and has an opening, wherein the jetting head unit and the electric circuit board are electrically connected with each other in the head holder; the jetting head unit is fixed to the head holder so as to airtightly close an inner space of the head holder with respect to an outside of the head holder; and the electric circuit board is fixed to the head holder to cover the opening and to airtightly close the inner space of the head holder with respect to the outside of the head holder, so that the one surface, of the electric circuit board, which is electrically insulated from the wiring and the circuit component, faces the outside of the head holder.

According to the first aspect of the present invention, the electric circuit board is fixed to the box-shaped head holder to cover the opening so as to airtightly close the inner space of the head holder with respect to the outside of the head holder, so that the surface, which is electrically insulated from the wiring and the circuit component, faces the outside of the head holder. Therefore, minute liquid droplets (mist) which are jetted from the nozzle and float without landing on a recording medium do not enter the head holder. Further, since the surface, of the electric circuit board, exposed to the outside of the head holder is electrically insulated from the wiring and the circuit component, it is possible to prevent electric short circuit caused by the mist. In addition, since the electric circuit board also serves as a cover closing the opening of the head holder, the number of parts is decreased, which can produce an effect of contributing to weight reduction and manufacturing cost reduction.

In the liquid droplet jetting apparatus of the present invention, the electric circuit board may have the wiring and the circuit component on the other surface opposite to the one surface. Alternatively, the electric circuit board may have the wiring and the circuit component on a side of the one surface, and the wiring and the circuit component may be covered by the electrically insulated surface.

In the liquid droplet jetting apparatus of the present invention, the electric circuit board may be detachably provided to the head holder. In this case, it is possible to connect connectors and terminals of wiring members while the electric circuit board is detached from the head holder and to fix the electric circuit board to the head holder without exposing their connection portions to the outside of the head holder. Further, the internal inspection of the head holder and parts replacement can be facilitated.

The liquid droplet jetting apparatus of the present invention may further include a sealing member which is interposed at a position at which the head holder and the electric circuit board face each other so as to surround a region, in the electric circuit board, in which the wiring and the circuit component are provided. This can produce an effect that airtightness at a portion, of the head holder, closed by the electric circuit board can be improved.

The liquid droplet jetting apparatus of the present invention may further include a first wiring member connecting the jetting head unit and the electric circuit board with each other, and one end portion of the first wiring member connected to the jetting head unit, the other end portion of the first wiring member connected to the electric circuit board, and the first wiring member may be arranged in the head holder. In this case, it is possible to prevent electric short circuit which might be caused if minute liquid droplets (mist) adhere to a connection portion between the jetting head unit and one end portion of the first wiring member and to a connection portion between the electric circuit board and the other end portion of the first wiring member.

According to a second aspect of the present invention, there is provided a liquid droplet jetting apparatus which jets liquid droplets of a liquid, including: a jetting head unit having a nozzle which jets the liquid droplets; an electric circuit board which has a wiring and a circuit component connected to the jetting head unit, and which has, one surface electrically insulated from the wiring and the circuit component, and has, on the other surface opposite to the one surface, a plurality of connectors electrically connected to the wiring and the circuit component; a box-shaped head holder which supports the jetting head unit and the electric circuit board and has an opening; and a control board which controls the jetting head unit; wherein the jetting head unit is fixed to the head holder so as to airtightly close an inner space of the head holder with respect to an outside of the head holder; the jetting head unit and the electric circuit board are electrically connected to each other in the head holder via a first wiring member connected to at least one connector among the connectors; the control board and the electric circuit board are electrically connected to each other via a second wiring member connected to another connector among the connectors; and the electric circuit board is fixed to the head holder to cover the opening of the head holder so as to airtightly close the inner space of the head holder with respect to the outside of the head holder, so that the surface on which the connectors are provided faces the inner space of the head holder.

According to the second aspect of the present invention, the electric circuit board is fixed to the head holder to cover the opening of the head holder so as to airtightly close the inner space of the head holder with respect to the outside of the head holder, so that the surface on which the connectors are provided faces the inner space of the head holder. Therefore, minute liquid droplets (mist) jetted from the nozzle and floating without landing on a recording medium do not enter the head holder. Further, since the surface, of the electric circuit board, exposed to the outside of the head holder is electrically insulated from the wiring and the circuit component, it is possible to prevent electric short circuit caused by the mist. Further, since the electric circuit board can also serve as a cover closing the opening of the head holder, the number of parts is decreased, which can produce an effect of contributing to weight reduction and manufacturing cost reduction. Moreover, since the connectors are provided to face the inner space of the head holder, it is not required to form, in the electric circuit board, a hole for inserting the first wiring member connecting the jetting head unit and the electric circuit board, and the length of the first wiring member can be shortened, compared with a case where the connectors are provided to face the outside of the head holder.

In the liquid droplet jetting apparatus of the present invention, the electric circuit board may be detachably provided to the head holder. In this case, it is possible to connect connectors and terminals of wiring members while the electric circuit board is detached from the head holder and to fix the electric circuit board to the head holder without exposing their connection portions to the outside of the head holder. Further, the internal inspection of the head holder and parts replacement can be facilitated.

In the liquid droplet jetting apparatus of the present invention, the wiring and the circuit component may be arranged on the other surface, of the electric circuit board, opposite to the one surface, so that a portion, of the electric circuit board, to which the wiring and the circuit component are electrically connected is not exposed to the one surface. In this case, since the wiring, the circuit component, and the portion in electrical continuity with the wiring and the circuit component are not exposed to the outside of the head holder when the electric circuit board is fixed to the head holder, it is possible to prevent electric short circuit caused by minute liquid droplets (mist).

In the liquid droplet jetting apparatus of the present invention, the electric circuit board may have, on the one surface, an insulating film made of an electrically insulative material and covering a portion, of the electric circuit board, to which the wiring and the circuit component are electrically connected; and a surface of the insulating film may form the insulated surface on the one surface. In this case, even if the portion, of the electric circuit board, to which the wiring and the circuit component are electrically connected exists on the one surface which is exposed to the outside of the head holder when the electric circuit board is fixed to the head holder, this portion is covered by the film made of the electrically insulative material. Therefore, electric short circuit caused by minute liquid droplets (mist) can be prevented.

In the liquid droplet jetting apparatus of the present invention, the electric circuit board may have the wiring and the circuit component on a side of the one surface, and the wiring and the circuit component may be covered by the insulated surface.

In the liquid droplet jetting apparatus of the present invention, a liquid tank which stores the liquid to be supplied to the jetting head unit may be arranged in the head holder. In this case, in the liquid droplet jetting apparatus in which the liquid tank storing the liquid to be supplied to the jetting head unit is disposed in the head holder, the opening of the head holder is closed by the electric circuit board, which can prevent minute liquid droplets (mist) from entering the head holder.

The liquid droplet jetting apparatus of the present invention may further include a sealing member which is interposed at a position at which the head holder and the electric circuit board face each other so as to surround a region, of the electric circuit board, in which the wiring and the circuit component are provided. This can produce an effect that airtightness at a portion, of the head holder, closed by the electric circuit board can be improved.

In the liquid droplet jetting apparatus of the present invention, the second wiring member which electrically connects the electric circuit board and a control board controlling the jetting head unit may be led out of the head holder via the sealing member between the head holder and the electric circuit board. In this case, since the second wiring member is led out via the sealing member between the head holder and the electric circuit board, it is possible to prevent minute liquid droplets (mist) from entering the head holder through a portion from which the second wiring member is led out.

DETAILED DESCRIPTION OF THE PREFERRED EMBODIMENTS

Figure 1:
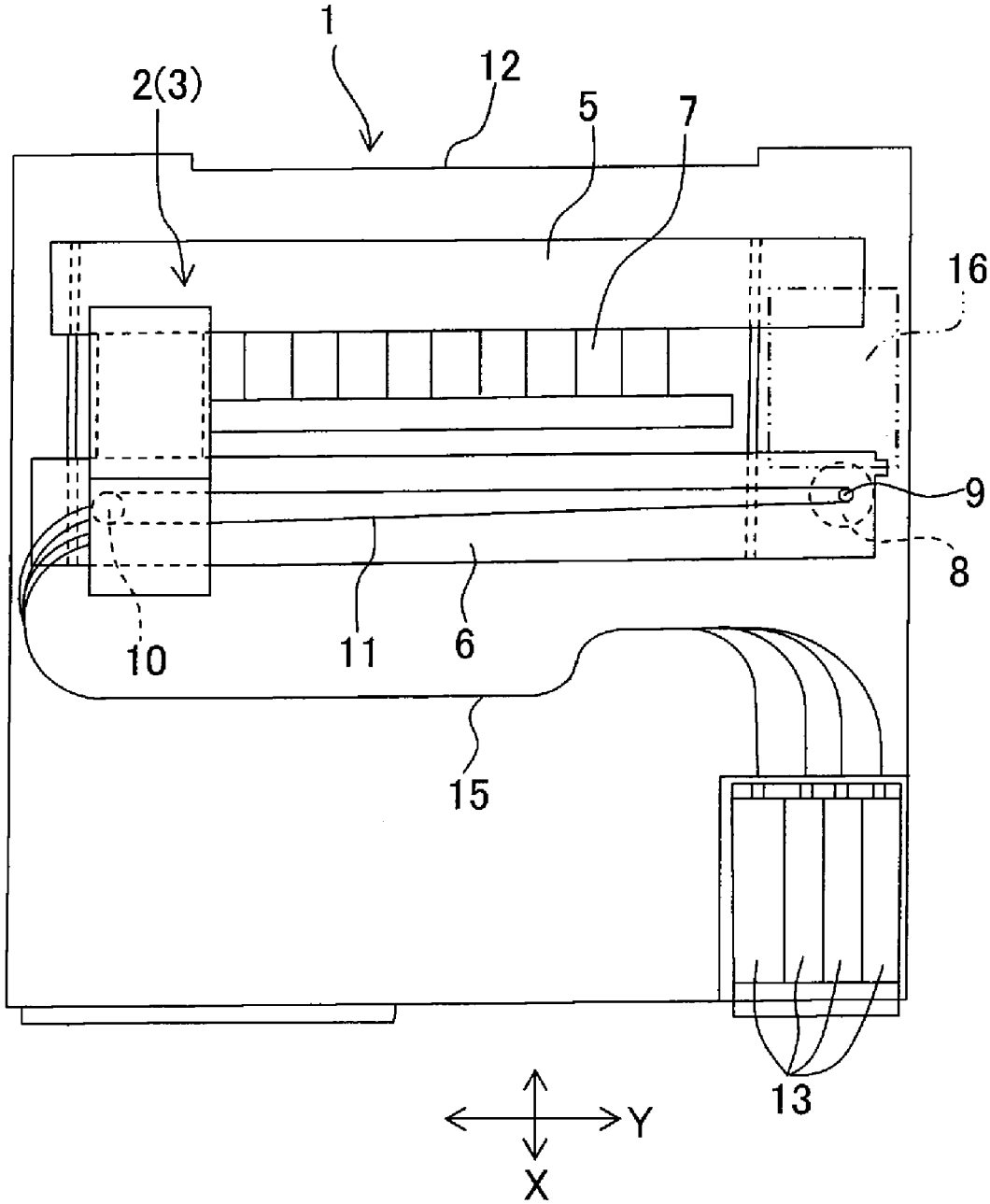
FIG. 1 is a schematic plane view of a recording apparatus as a liquid droplet jetting apparatus of the present invention.

Hereinafter, a basic embodiment of the present invention will be explained. FIG. 1 is a schematic plane view of an ink-jet recording apparatus 1 as a liquid droplet jetting apparatus of the present invention. The recording apparatus 1 may be applied to a stand-alone printer apparatus or may be applied to a printer function (recording unit) of a multi-function device having a plurality of functions such as a facsimile function and a copy function.

Figure 2:
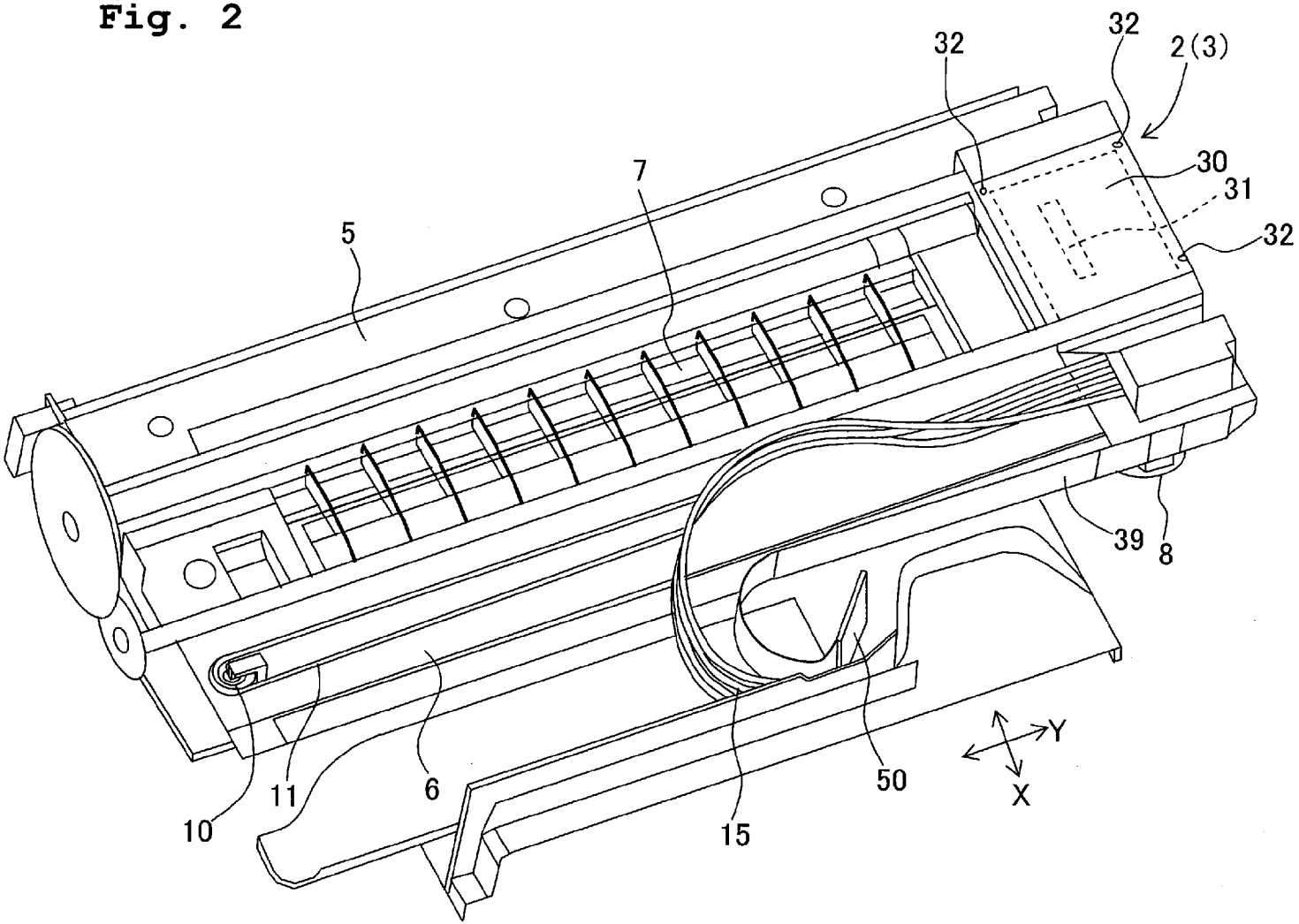
FIG. 2 is a perspective view of a recording unit according to the liquid droplet jetting apparatus.

As shown in FIG. 1 and FIG. 2, the recording apparatus 1 includes a box-shaped head holder 3 which forms a carriage 2. On a side of a lower surface of the head holder 3, a jetting head unit 4 is mounted, so that its nozzles 4*a* are downwardly exposed. The carriage 2 is supported by a first guide member 5 and a second guide member 6 to be reciprocatable in a main scanning direction (Y direction), and is reciprocated along the Y direction by a timing belt 11 hung around a drive pulley 9 and a driven pulley 10, the drive pulley 9 being coupled to a carriage motor 8.

Paper as a recording medium is carried in a sub-scanning direction (X direction) perpendicular to the main scanning direction (Y direction) while being placed on an upper surface of a platen 7 in a flat plate shape arranged below the carriage 2.

In a main body 12 of the recording apparatus 1, replaceable ink cartridges 13 are fixedly disposed, and here four ink cartridges 13 for black ink, cyan ink, magenta ink, and yellow ink are provided according to the number of ink colors. In this embodiment, the case in which the number of ink colors is four is explained as an example, but the number of the ink colors is not limited to four, nor is the number of the ink cartridges 13 limited to four. The inks in the respective ink cartridges 13 are independently supplied to a liquid tank 24 (to be described later) of the carriage 2 via a flexible ink supply tube 15 made of resin.

As shown in FIG. 1 and FIG. 2, in the main body 12 of the recording apparatus 1, a maintenance unit 16 is provided on one side (right side in FIG. 1) outside a width (recording area) of the paper in Y-direction. The maintenance unit 16 performs a recovery operation (purging) for recovering a jetting function of the jetting head unit 4 (to be described later).

Figure 4:
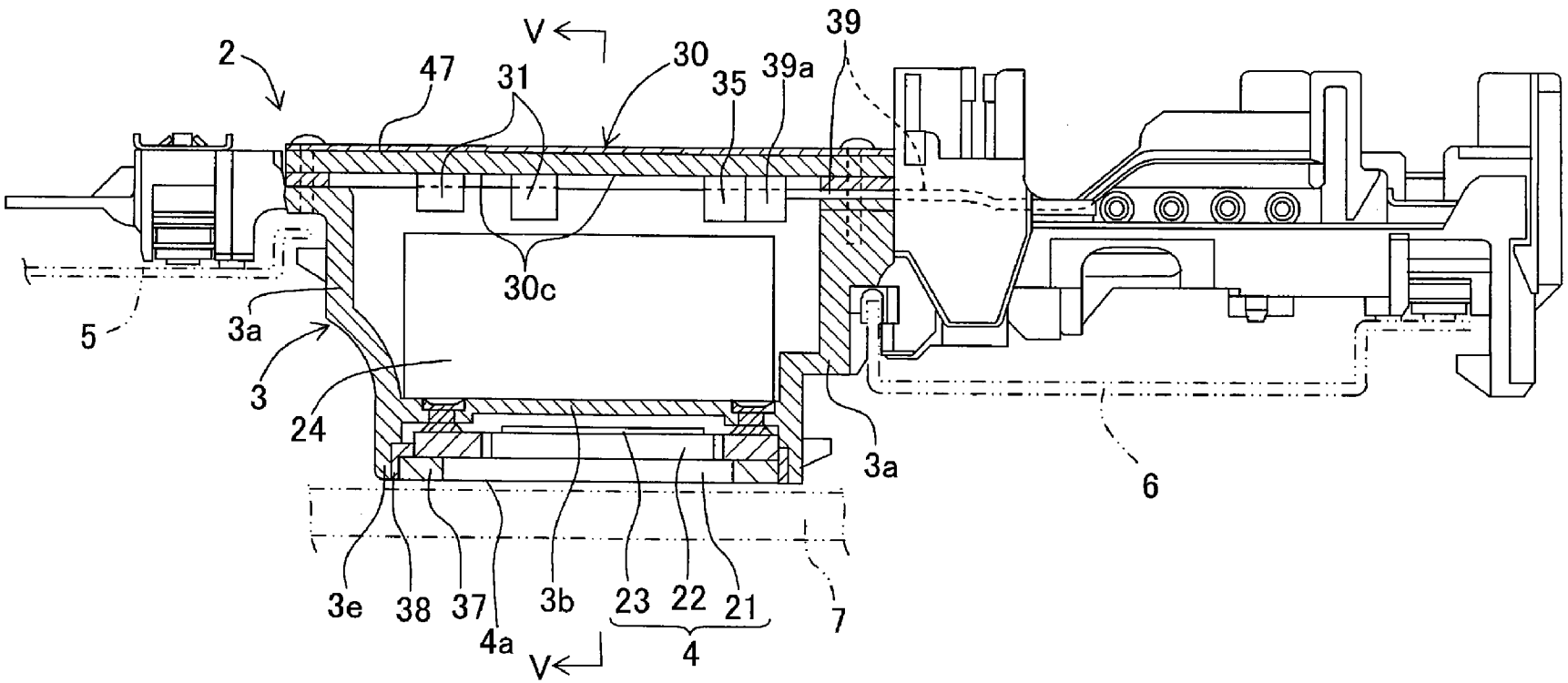
FIG. 4 is a partly cut-out sectional view showing the inside of a head holder of the liquid droplet jetting apparatus.
Figure 5:
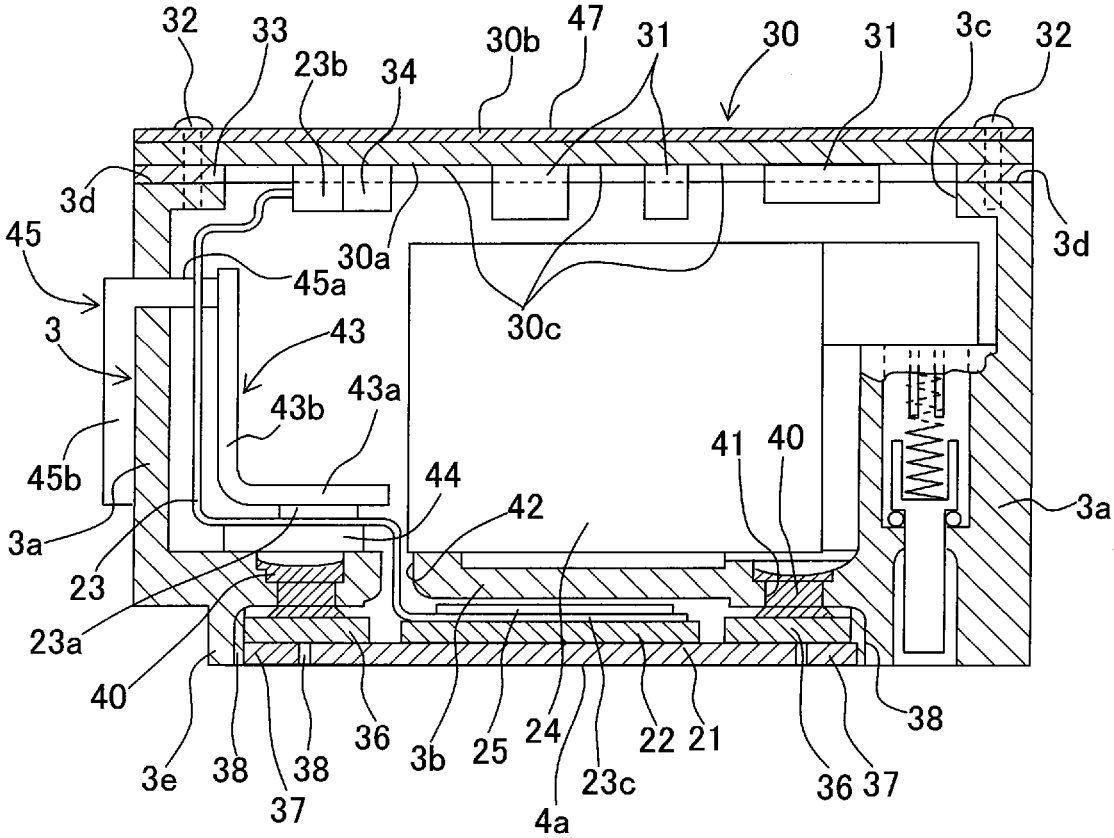
FIG. 5 is a cross-sectional view seen in the direction of the arrows V-V in FIG. 4.

Next, the structure of the carriage 2 will be explained. As shown in FIG. 4 and FIG. 5, the jetting head unit 4 is fixed to the lower surface of the box-shaped head holder 3 and upper surface of the head holder 3 is open. In the head holder 3, the liquid tank 24 is disposed above the jetting head unit 4, and an electric circuit board 30 is disposed above the liquid tank 24 so as to close the upper surface of the head holder 3. The head holder 3 is a synthetic resin product formed by injection molding, and has four sidewalls 3*a* and a bottom plate 3*b*, and has an upper surface opening 3*c*.

On a flat surface 30*a* (lower surface in FIG. 5) of the electric circuit board 30, there is formed an electric circuit (wiring) 30*c* by a known printed circuit so as to extend along the surface 30*a*, and there is provided a plurality of circuit elements 31 (circuit components) such as a bypass capacitor and a resistor, a first connector 34, and a second connector 35 which are connected to the electric circuit 30*c*. The electric circuit board 30 itself is made of an electrically insulative material made of glass fiber, epoxy resin, and the like and is formed as a substantially rigid body in a plate shape. Portions to which the aforesaid electric circuit 30*c*, circuit elements 31, and connectors 34, 35 are connected are not exposed to the other flat surface 30*b* (upper surface in FIG. 5) of the electric circuit board 30. Namely, the other flat surface 30*b* is electrically insulated from the electric circuit 30*c* and the circuit elements 31.

When the circuit elements 31 and the connectors 34, are placed on and adhered to the electric circuit 30*c* provided on the lower surface 30*a* of the electric circuit board 30 via a conductive brazing material or a conductive adhesive, there is no need to form through holes in the electric circuit board 30. Namely, it is possible to have the conductive portions not exposed to the upper surface 30*b*. Further, when the terminals of the circuit elements 31 are connected to the electric circuit 30*c*, in a case in which terminals of the circuit elements 31 are inserted in through holes formed in the electric circuit board 30 to be exposed to the upper surface 30*b*, an insulation film 47 made of an ink-proof, electrically insulative material may be formed to cover the exposed portions. In a case in which the electric circuit 30*c* is formed on the upper surface 30*b*, the insulation film 47 may be formed to cover the whole electric circuit 30*c*. In these cases, a surface of the insulation film 47 forms an insulated surface on the upper surface 30*b*.

The electric circuit board 30 is mounted so as to close the opening 3*c* of the head holder 3, in a state that the electric circuit 30*c*, the circuit elements 31, and the connectors 34, 35 face an inner space of the head holder 3. Namely, the electric circuit board 30 is mounted on the head holder 3 so that the lower surface 30*a* faces downward and the upper surface 30*b* faces outside of the head holder 3. At this time, a sealing member 33 in a frame shape in a plane view is interposed along the whole periphery of a portion at which upper end surfaces 3*d* of the sidewalls 3*a* of the head holder 3 and the lower surface 30*a* of the electric circuit board 30 face each other, in other words, between a periphery of the opening of the head holder 3 and an outer periphery of the electric circuit board 30. Then, the electric circuit board 30 is detachably fixed to the head holder 3 by fastening means such as screws 32. In this manner, the electric circuit board 30 is airtightly fixed to the head holder 3 to cover the opening so that the inner space of the head holder 3 is closed with respect to outside above the head holder 3.

Figure 3:
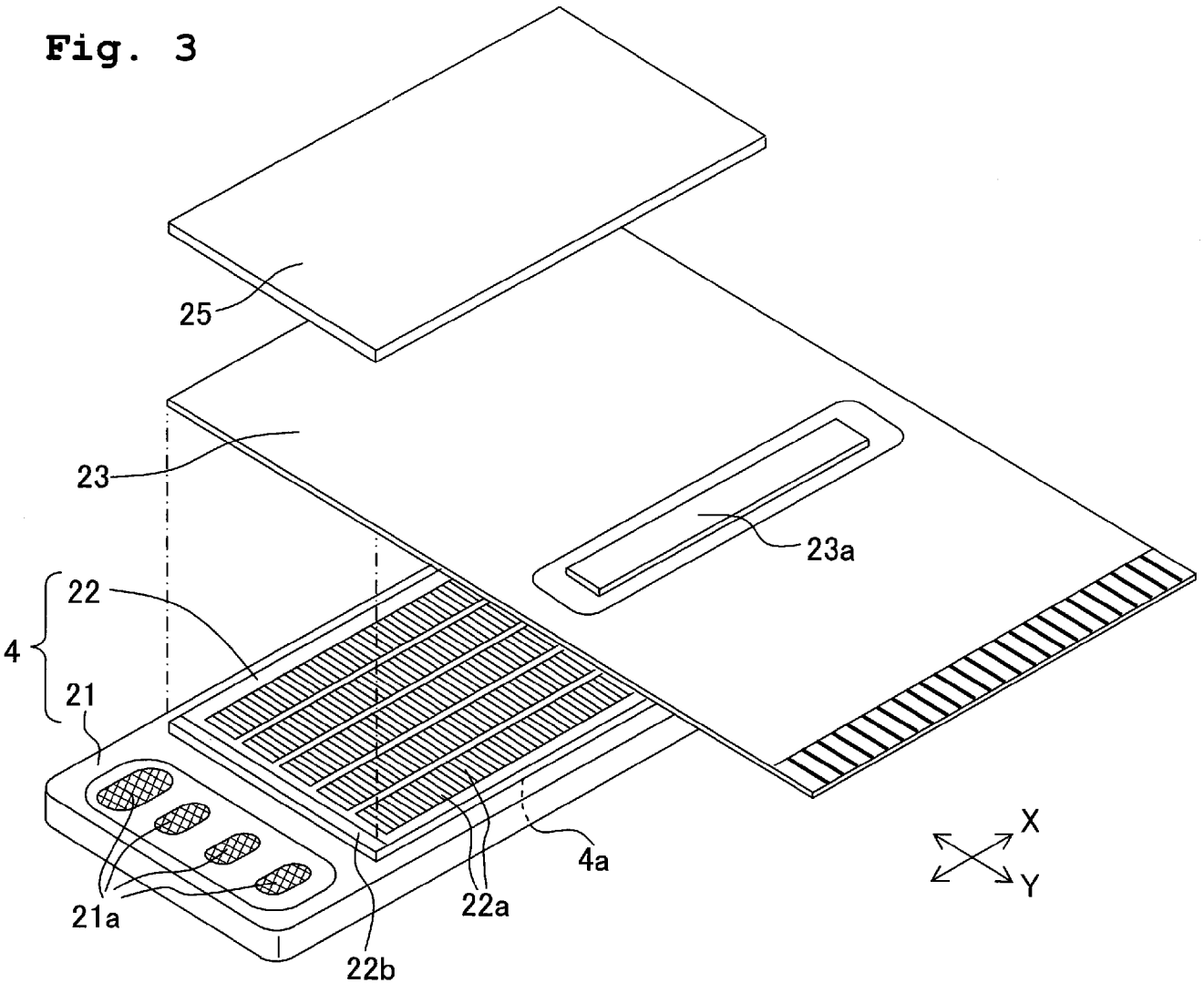
FIG. 3 is an exploded perspective view of a jetting head unit.

In the jetting head unit 4, as in the ink-jet recording head described in U.S. Pat. No. 7,294,952 (corresponding to Japanese Patent Application Laid-open No. 2005-322850), a cavity unit 21 in a flat plate shape and an actuator 22 are stacked as shown in FIG. 3. The cavity unit 21 has nozzles 4*a* formed on a lower surface thereof and pressure chambers formed on an upper surface side. One end 23*c* of a flexible wiring member 23 as a first wiring member having flexibility is connected to an upper surface of the actuator 22, and a radiation plate 25 made of a metal plate is further stacked on and adhered to an upper surface of the flexible wiring member 23 so as to overlap with the actuator 22.

The cavity unit 21 is formed of a stack of a plurality of thin plates, and ink supply channels are formed in the cavity unit 21. When supplied with the ink in the liquid tank 24 through ink inlet ports 21*a*, the ink supply channels distribute the ink to a large number of the nozzles 4*a*.

As shown in FIG. 3, the actuator 22 includes a plurality of ceramic layers which are formed in a flat shape having a size large enough to cover all the nozzles 4*a* and which are stacked in a direction perpendicular to the flat direction; and a plurality of internal electrodes arranged between the ceramic layers.

The internal electrodes are formed as pairs of electrodes at positions corresponding to the large number of nozzles 4*a* respectively, the electrodes in each pair sandwiching the ceramic layer. In each of the pairs of electrodes, one electrode is connected to one of individual external electrodes 22*a* formed on an uppermost surface of the actuator 22, and the other electrode is connected to common external electrode 22*b*. These individual external electrodes 22*a* and the common external electrode 22*b* are connected to wiring patterns of the flexible wiring member 23 respectively.

In the actuator 22 in which the electrodes are arranged in this manner, when voltage is applied between the individual external electrode and the common external electrode, portions, of the ceramics layers, sandwiched by the internal electrodes expand and thus can apply a pressure to an ink in corresponding nozzles 4*a*. As a result, the ink (liquid droplets) is jetted from the nozzle. The disclosure of U.S. Pat. No. 7,294,952 is incorporated herein by reference.

On a lower surface side of the bottom plate 3*b* of the head holder 3, the jetting head unit 4 is fixed via a reinforcing frame 36 by an adhesive 40. For this purpose, a plurality of through holes 41 into which the adhesive 40 is poured are formed in the bottom plate 3*b* (see FIG. 5).

On the lower surface of the head holder 3, a rib 3*e* projecting toward a recording medium (lower side) is provided so as to surround the jetting head unit 4. In other words, the jetting head unit 4 is arranged inside a recess which is formed by the rib 3*e* on the lower surface side of the bottom plate 3*b*.

In order to lessen a level difference (unevenness) on the side of the lower surface (surface facing the recording medium) of the head holder 3, a front frame 37 is provided inside the rib 3*e* so as to surround the jetting head unit 4. The front frame 37 is adhered to a lower surface of the reinforcing frame 36 by an adhesive.

A gap between an outer periphery of the front frame 37 and an inner periphery of the rib 3*e* of the head holder 3, and a gap between an outer periphery of the jetting head unit 4 and an inner periphery of the front frame 37 are sealed by seals 38 made of ink-proof silicone resin or the like. In the bottom plate 3*b* of the head holder 3, an opening (not shown) through which a liquid channel pipe (not shown) for supplying the ink in the liquid tank 24 to the jetting head unit 4 is inserted and a slit 42 through which the flexible wiring member 23 is inserted are formed. The outer periphery of the jetting head unit 4 is airtightly fixed to the head holder 3 as described above so as to close the opening and the slit 42 with respect to outside under the head holder 3.

The flexible wiring member 23 is inserted from an upper surface of the jetting head unit 4 through the slit 42 formed in the bottom plate 3*b* of the head holder 3, and is led into the head holder 3. A terminal 23*b* at an end portion of the flexible wiring member 23 is connected to the first connector 34 provided on the lower surface 30*a* of the electric circuit board 30 (see FIG. 5). That is, the end portion of the flexible wiring member 23 connected to the jetting head unit 4, the connection terminal 23*b* of the flexible wiring member 23 connected to the electric circuit board 30, and the flexible wiring member 23 are arranged in the head holder 3. A space formed by the lower surface of the bottom plate 3*b* and the rib 3*e* of the head holder 3, the front frame 37, and the jetting head unit 4 is also confined in the head holder 3. The electric circuit board 30 is connected to a controller 50 (control board) disposed in the apparatus main body 12, via a flexible wiring cable 39 (see FIG. 2, a second wiring member) in order to receive a driving signal from the controller 50. The wiring cable 39 has, at its end portion, a terminal 39*a* connected to the second connector 35 provided on the lower surface 30*a* of the electric circuit board 30. The wiring cable 39 is led out of the head holder 3 via the sealing member 33 between the upper end surface 3*d* of one of the sidewalls 3*a* of the head holder 3 and the electric circuit board 30 and is connected to the controller 50. In this case, the sealing member 33 seals a portion from which the wiring cable 39 is led out, thereby ensuring that the inner space of the head holder 3 is kept airtight (see FIG. 4).

The wiring cable 39 may be led out of the head holder 3 from a through hole formed in the sidewall 3*a* of the head holder 3, instead of being led out of the head holder 3 via the sealing member 33 between the upper end surface 3*d* of the sidewall 3*a* of the head holder 3 and the electric circuit board 30. In this case, a sealing member closes a gap between the wiring cable 39 and the through hole to ensure airtightness.

On a middle portion of the flexible wiring member 23, a drive circuit element 23*a* formed as an IC chip is mounted to drive the actuator 22 (see FIG. 3 and FIG. 5). The drive circuit element 23*a* converts the driving signals serially transmitted from the controller 50 in the apparatus main body 12 into parallel signals corresponding to the large number of nozzles 4*a* to output the parallel signals as voltages suitable for driving the ceramics layers.

At the time of recording, the drive circuit element 23*a* generates heat since it outputs the driving signal so that a large number of the nozzles 4*a* jet the ink with a high frequency. In order to radiate the heat of the drive circuit element 23*a*, a radiator 43 is fixed on a side of an upper surface of the bottom plate 3*b* by a pin (not shown). As the radiator 43, for example, a metal member of aluminum or the like is usable. The radiator may be composed of a bottom portion 43*a* substantially parallel to the bottom plate 3*b* and in close contact with the drive circuit element 23*a*, and a side portion 43*b* extending along the sidewall 3*a* of the head holder 3 to guide the flexible wiring member 23 toward the electric circuit board 30, the bottom portion 43*a* and the side portion 43*b* forming an L-shape in a side view. However, the shape of the radiator 43 is not limited to this. A rubber elastic member 44 is arranged between the bottom plate 3*b* and the flexible wiring member 23 in order to bring the drive circuit element 23*a* into close contact with the radiator 43 so as to enable the heat transfer. In order to guide the heat of the radiator 43 to the outside of the head holder 3 to diffuse the heat to the outside atmosphere, a diffuser plate 45 is provided. The diffuser plate 45 is composed of a connection portion 45*a* penetrating through the sidewall 3*a* of the head holder 3 to be connected to the side portion 43*b* of the radiator 43, and a diffuser portion 45*b* parallel to an outer surface of the sidewall 3*a* (see FIG. 5). The portion, of the sidewall 3*a*, through which the connection portion 45*a* penetrates is also airtightly closed.

When the jetting head unit 4 performs a recording operation by the nozzles 4*a* jetting the ink toward a paper as the recording medium, minute ink droplets in mist form (ink mist) are generated together with the ink droplets landing on the paper. If such floating ink mist enters the inner space of the head holder 3 of the recording apparatus 1 to adhere to the conductive portions, electric short circuit may occur as described above. However, in this embodiment, the jetting head unit 4 and the electric circuit board 30 are fixed to the head holder 3 so that the inner space of the head holder 3 is airtightly closed with respect to outside of the head holder 3. Therefore, the conductive portions such as the electric circuit 30*c* and the circuit elements 31 on the electric circuit board 30, the external electrodes 22*a*, 22*b* of the actuator 22, and connection portions between the connectors 34, 35 and the wiring members 23, 39 do not come into contact with the ink mist. Further, the electric circuit board 30 also functions to close the opening of the head holder 3, but the surface, of the electric circuit board 30, exposed to the outside of the head holder 3 is electrically insulated from the electric circuit 30*c* and the circuit elements 31. This can prevent corrosion and an accident such as electric short circuit of these components and connection portions. Further, since the connector 34 is provided to face the inner space of the head holder 3, there is no need to form, in the electric circuit board 30, a hole through which the flexible wiring member 23 connecting the jetting head unit 4 and the electric circuit board 30 is inserted, and the length of the flexible wiring member 23 can be shortened, compared with a case in which the connector is provided to face outside of the head holder 3.

Further, since the electric circuit board 30 is detachably attached to the head holder 3, it is possible to connect the connectors 34, 35 and the terminals of the wiring members 23, 39 while the electric circuit board 30 is detached from the head holder 3 and to fix the electric circuit board 30 to the head holder 3 without exposing their connection portions to the outside of the head holder 3 as described above. Further, the internal inspection of the head holder 3 and part replacement can be facilitated. Preferably, the connectors 34, 35 and the terminals of the wiring members 23, 39 are detachably connected so that the replacement of the electric circuit board 30 and the wiring members 23, 39 is facilitated.

Figure 6:
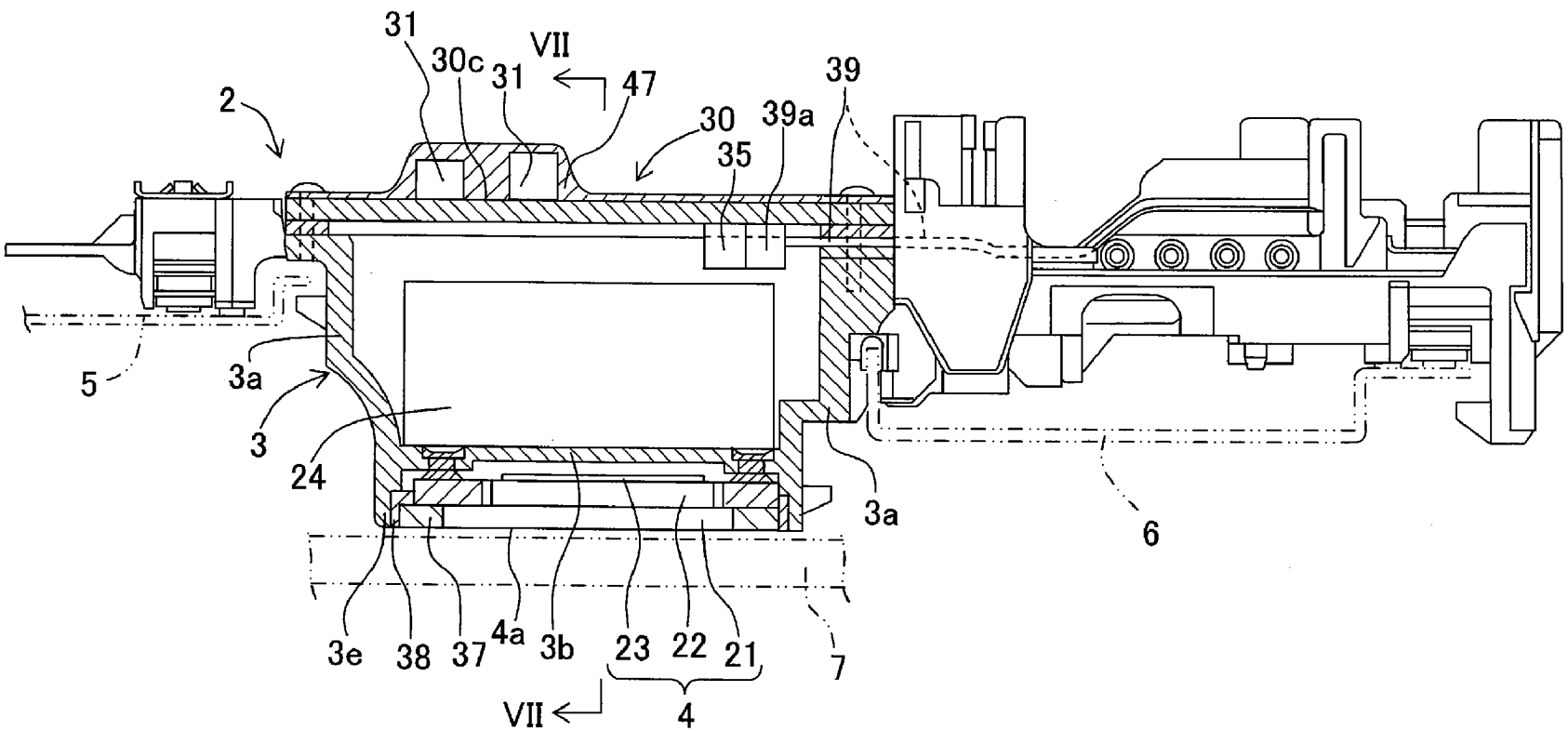
FIG. 6 is a cross-sectional view corresponding to FIG. 4, in a second embodiment.
Figure 7:
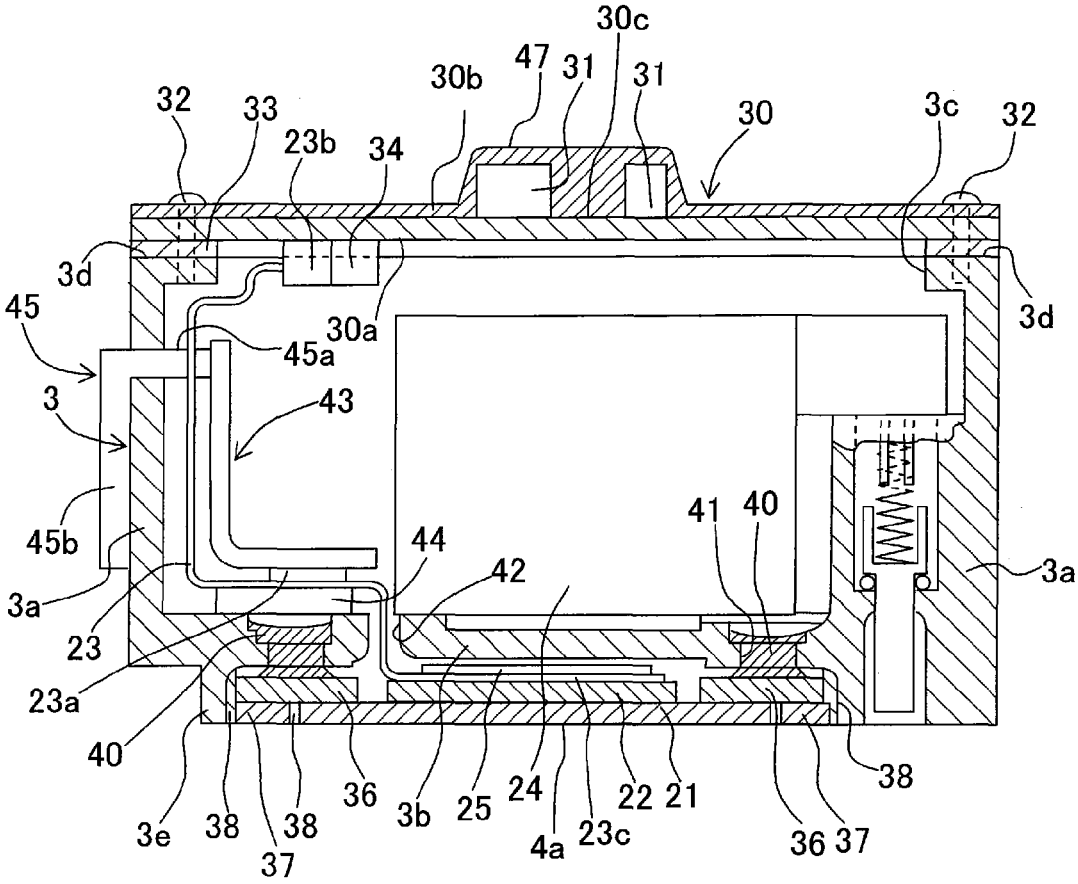
FIG. 7 is a cross-sectional view seen in the direction of the arrows VII-VII in FIG. 6 in the second embodiment.

A second embodiment of the present invention will be explained with reference to FIG. 6 and FIG. 7. In the second embodiment, an electric circuit 30*c* and circuit elements 31 are arranged on an externally exposed upper surface 30*b* of an electric circuit board 30, and an ink-proof electric insulation film 47 is formed on the upper surface 30*b* so as to cover the electric circuit 30*c* and the circuit elements 31. The electric circuit board 30 has, on its lower surface 30*a* facing an inner space of a head holder 3, a first connector 34 which is connected to a terminal 23*b* at an end portion of a flexible wiring member (COF) 23 as a first wiring member and a second connector 35 which is connected to a terminal 39*a* of a wiring cable 39 as a second wiring member. The electric circuit 30*c* on the upper surface 30*b* and the connectors 34, 35 on the lower surface 30*a* are connected to each other by conductive members penetrating through the electric circuit board 30 in a thickness direction. The aforesaid electric circuit 30*c* may be formed on the lower surface 30*a* instead of the upper surface 30*b*.

The other structure is the same as that of the first embodiment, and therefore the same components are denoted by the same reference numerals and symbols and detailed explanation thereof will be omitted.

In the second embodiment, since the first connector 34 and the second connector 35 are also arranged inside the head holder 3, ink mist does not come into contact with a connection portion between the terminal 23*b* at the end portion of the flexible wiring member 23 and the first connector 34 or with a connection portion between the terminal 39*a* of the wiring cable 39 and the second connector 35. This can prevent an adverse effect caused by the ink mist, that is, corrosion and an accident such as electric short circuit of the components.

Further, even though the electric circuit 30*c* and the circuit elements 31 provided on the upper surface 30*b* of the electric circuit board 30 are exposed to the outside of the head holder 3, these portions are covered by the insulation film 47 made of an ink-proof, electrically insulative material. This can prevent an adverse effect caused by the ink mist, that is, corrosion and an accident such as electric short circuit of the electric circuit 30*c* and the circuit elements 31 provided on the upper surface 30*b* of the electric circuit board 30.

In the above-described embodiments, the upper opening of the head holder 3 is closed by the electric circuit board 30, but an opening may be provided in the sidewall 3*a* of the head holder 3 and the opening may be closed by the electric circuit board 30. A still another possible structure is to arrange the jetting head unit 4 on the sidewall 3*a* or the upper surface of the head holder 3 and to arrange the electric circuit board 30 on the lower surface of the head holder 3. In any of these cases, the electric circuit board 30 is arranged so that the conductive portions are not exposed to the outside of the head holder 3.

In the above-described first embodiment, the ink-proof electric insulative cover 47 is formed on the upper surface 30*b* of the electric circuit board 30, but the upper surface 30*b* of the electric circuit board 30 may be made of metal, and this metal surface may be kept at a ground potential. In this case, the same effects as those of the first embodiment can also be obtained.

Further, as the jetting head unit 4, not only a jetting head which jets liquid droplets when the piezoelectric actuator is driven, but also a jetting head which drives a vibration plate by static electricity to jet liquid droplets, a jetting head which jets ink by boiling the ink by a heater, and the like are usable.

In the above-described embodiments, one example in which the present invention is applied to the recording apparatus as an example of the jetting apparatus which jets ink is explained. However, the present invention is also applicable to an apparatus jetting liquid other than ink, provided that this is an apparatus in which minute liquid droplets generated when the liquid is jetted have to be prevented from entering a head holder including a jetting head unit. For example, the present invention is applicable to an apparatus jetting a coloring liquid coloring a color filter or the like of a liquid display, and to liquid droplet jetting apparatuses used in various fields such as fields of medicine and analysis.

What is claimed is:

1. A liquid droplet jetting apparatus which jets liquid droplets of a liquid, comprising:

a jetting head unit having a nozzle which jets the liquid droplets;

an electric circuit board having a wiring and a circuit component which are connected to the jetting head unit and having one surface which is electrically insulated from the wiring and the circuit component; and a box-shaped head holder which supports the jetting head unit and the electric circuit board and which has an upper surface opening and a bottom plate in which a through hole is formed, wherein the jetting head unit and the electric circuit board are electrically connected with each other in the head holder;

the jetting head unit is fixed to the bottom plate of the head holder to cover the through hole so as to airtightly close an inner space of the head holder with respect to an outside of the head holder; and the electric circuit board is fixed to the head holder to cover the upper surface opening so as to airtightly close the inner space of the head holder with respect to the outside of the head holder, so that the one surface, of the electric circuit board, which is electrically insulated from the wiring and the circuit component, faces the outside of the head holder.

2. The liquid droplet jetting apparatus according to claim 1, wherein the electric circuit board has the wiring and the circuit component on the other surface opposite to the one surface.

3. The liquid droplet jetting apparatus according to claim 1, wherein the electric circuit board has the wiring and the circuit component on a side of the one surface, and the wiring and the circuit component are covered by the electrically insulated surface.

4. The liquid droplet jetting apparatus according to claim 1, wherein the electric circuit board is detachably provided to the head holder.

5. The liquid droplet jetting apparatus according to claim 4, further comprising a sealing member which is interposed at a position at which the head holder and the electric circuit board face each other so as to surround a region, in the electric circuit board, in which the wiring and the circuit component are provided.

6. The liquid droplet jetting apparatus according to claim 1, further comprising a first wiring member connecting the jetting head unit and the electric circuit board with each other, wherein one end portion of the first wiring member connected to the jetting head unit, the other end portion of the first wiring member connected to the electric circuit board, and the first wiring member are arranged in the head holder.

7. A liquid droplet jetting apparatus which jets liquid droplets of a liquid, comprising:

a jetting head unit having a nozzle which jets the liquid droplets;

an electric circuit board which has a wiring and a circuit component connected to the jetting head unit, and which has, one surface electrically insulated from the wiring and the circuit component, and has, on the other surface opposite to the one surface, a plurality of connectors electrically connected to the wiring and the circuit component;

a box-shaped head holder which supports the jetting head unit and the electric circuit board and which has an upper surface opening and a bottom plate in which a through hole is formed; and a control board which controls the jetting head unit;

wherein the jetting head unit is fixed to the bottom plate of the head holder to cover the through hole so as to airtightly close an inner space of the head holder with respect to an outside of the head holder;

the jetting head unit and the electric circuit board are electrically connected to each other in the head holder via a first wiring member connected to at least one connector among the connectors;

the control board and the electric circuit board are electrically connected to each other via a second wiring member connected to another connector among the connectors; and the electric circuit board is fixed to the head holder to cover the upper surface opening of the head holder so as to airtightly close the inner space of the head holder with respect to the outside of the head holder, so that the surface on which the connectors are provided faces the inner space of the head holder.

8. The liquid droplet jetting apparatus according to claim 7, wherein the electric circuit board is detachably provided to the head holder.

9. The liquid droplet jetting apparatus according to claim 8, wherein the wiring and the circuit component are arranged on the other surface, of the electric circuit board, opposite to the one surface, so that a portion, of the electric circuit board, to which the wiring and the circuit component are electrically connected is not exposed to the one surface.

10. The liquid droplet jetting apparatus according to claim 8, wherein the electric circuit board has, on the one surface, an insulating film made of an electrically insulative material and covering a portion, of the electric circuit board, to which the wiring and the circuit component are electrically connected; and a surface of the insulating film forms the insulated surface on the one surface.

11. The liquid droplet jetting apparatus according to claim 8, wherein the electric circuit board has the wiring and the circuit component on a side of the one surface, and the wiring and the circuit component are covered by the insulated surface.

12. The liquid droplet jetting apparatus according to claim 8, wherein a liquid tank which stores the liquid to be supplied to the jetting head unit is arranged in the head holder.

13. The liquid droplet jetting apparatus according to claim 8, further comprising a sealing member which is interposed at a position at which the head holder and the electric circuit board face each other so as to surround a region, of the electric circuit board, in which the wiring and the circuit component are provided.

14. The liquid droplet jetting apparatus according to claim 13, wherein the second wiring member which electrically connects the electric circuit board and a control board controlling the jetting head unit is led out of the head holder via the sealing member between the head holder and the electric circuit board.

* * * * *